US006899484B2

(12) United States Patent
Ohba

(10) Patent No.: US 6,899,484 B2
(45) Date of Patent: May 31, 2005

(54) STICK TYPE COSMETIC MATERIAL FEEDING CONTAINER

(75) Inventor: Atsushi Ohba, Tokyo (JP)

(73) Assignee: Suzuno Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/453,544

(22) Filed: Jun. 4, 2003

(65) Prior Publication Data

US 2004/0151529 A1 Aug. 5, 2004

(30) Foreign Application Priority Data

Feb. 5, 2003 (JP) ..... 2003-27795

(51) Int. Cl.[7] ..... B43K 21/22; A45D 40/02
(52) U.S. Cl. ..... 401/92; 401/86; 401/87
(58) Field of Search ..... 401/73, 75, 76, 401/68, 86, 87, 92

(56) References Cited

U.S. PATENT DOCUMENTS 6,499,897 B2 * 12/2002 Yamamoto ..... 401/75 X

* cited by examiner

*Primary Examiner*—David J. Walczak
(74) *Attorney, Agent, or Firm*—Rabin & Berdo, P.C.

(57) ABSTRACT

A front cylinder and base are rotatably connected. Relative rotations cause stick-type cosmetic material retained by a core chuck member to slide forward and backward along an axial hole of the cylinder. Axially extending first slide grooves along an inner circumference of the hole have an inside diameter almost equal to a diameter of the material. Second grooves, deeper than the first, extend continuously from ends of the first grooves. Claws at a front-end section of the chuck retain the material and are slidably guided by the grooves. Back surfaces of the claws slide into contact with bottoms of the first grooves. Inner surfaces of the claws almost coincide with an inside diameter of the hole. If the material is loaded in the chuck with the claws at the second grooves, the claws elastically deform outward and the claws receive the material. With the claws at the first grooves, the claws tightly sandwich the material.

4 Claims, 12 Drawing Sheets

(A)

(B)

(C)

STICK TYPE COSMETIC MATERIAL FEEDING CONTAINER

BACKGROUND OF THE INVENTION

1. Field of the Invention

The present invention relates to a container for feeding a stick type cosmetic material, such as an eyebrow pencil, an eyeliner, a lip liner, and the like. It particularly relates to a method for loading a core material in the container.

2. Description of the Related Art

FIGS. 12 and 13 show a method for loading a stick type cosmetic material whose core has a thin diameter, such as a conventional eyebrow pencil and the like, in a stick type cosmetic Stick type cosmetic materials have diameters that vary in size from a material having a large diameter to a material having a small diameter, such as a lipstick, an eyebrow pencil, an eyeliner, and the like. Manufacturing methods of such stick type cosmetic materials are roughly divided into molding of a core by die and extrusion of a core by machine.

A core used for a stick type cosmetic material in a free form, such as a lipstick, is manufactured mainly by molding. With respect to a core having a small diameter, such as an eyebrow pencil and the like, there are many cases in which a core material is extruded with a uniform diameter, cut and then used. material retaining section 331 formed at a front end of a core chuck member 330 which vertically travels in a front cylinder 310.

Usually the stick type cosmetic material retaining section 331 is in the shape of a cup as shown in the drawings and it is arranged such that the stick type cosmetic material is forced to fit in a cavity section which is bored in this cup section.

Therefore, in many cases, some vertical ribs are formed on an inner circumferential surface of the cup section and because the vertical ribs cut into a part of the stick type cosmetic material when the stick type cosmetic material is inserted, engagement force is increased or the stick type cosmetic material is forced to fit in the cup in which no ribs are formed with an outer circumferential surface of the stick type cosmetic material being slightly scraped.

FIG. 12 shows a state in which the core chuck member 330 is fed up to the advance limit in order for a core material having a thin diameter, such as an eyebrow pencil or the like, to fit in the stick type cosmetic material retaining section 331. A stick type cosmetic material D is forced to fit in the stick cosmetic material retaining section 331 through a front end opening hole by a skillful operator in such a state that the core chuck member 330 is fed up to the advance limit.

Feeling the resistance at the time of loading the stick type cosmetic material, the operator securely fits the stick type cosmetic material D in the stick type cosmetic material retaining section 331. The operator then feeds down the core chuck member 330 to the retreat limit as shown in FIG. 13, whereby a loading operation is completed.

The reason why the core material is loaded after the core chuck member 330 is fed up to the advance limit is as follows. As shown in FIG. 13, due to a thickness X of the circumference of the cosmetic material retaining section 331, there is a gap between an outer circumference of the stick type cosmetic material D and a through hole 313 in which the core chuck member 330 slides. If the stick type cosmetic material retaining section 331 is far away from a front end opening hole 311, it will not be easy to put the stick type cosmetic material D, which has been inserted through the front end opening hole 311, in a cavity section of the stick type cosmetic material retaining section 331. Therefore, operations will not be easy unless the front end opening hole 311 is kept close to the stick type cosmetic material retaining section 331 by feeding up the core chuck member 330 up to the advance limit.

SUMMARY OF THE INVENTION

An advantage of the present invention is to provide a stick type cosmetic material container which is capable of securely retaining a stick type cosmetic material with strong retaining force without letting a part of the stick type cosmetic material cut in a stick type cosmetic material retaining section or without scraping the stick type cosmetic material when the stick type cosmetic material is loaded.

A further advantage of the present invention is to provide a stick type cosmetic material container which does not require a special skill in loading work for the stick type cosmetic material and is capable of enhancing an efficiency of the loading work.

Therefore, the present invention is a stick type cosmetic material feeding container which has a front cylinder and a base body rotatably connected with the front cylinder and in which due to relative rotations of the front cylinder and the base body, a stick type cosmetic material retained by a core chuck member slides forward and backward along a through hole which extends in an axial direction in the front cylinder.

The stick type cosmetic material feeding container comprises: a plurality of first slide grooves formed along an inner circumference of a through hole having an inside diameter which is almost equal to an outside diameter of the stick type cosmetic material, the first slide grooves extending in an axial direction; a plurality of second slide grooves which are located at ends of the first slide grooves, formed continuously from the ends, and deeper than the first slide grooves; and a plurality of claws which are formed at a front end section of the core chuck member so as to retain the stick type cosmetic material and slidably guided by the first slide grooves and the second slide grooves, the back surfaces of which slide and come into contact with bottoms of the first slide grooves, and the inner surfaces of which almost coincide with an inside diameter of the through hole.

If the stick type cosmetic material is loaded in the core chuck member when the claws are located at the second slide grooves, the claws will elastically be deformed in the direction of an outer circumference and the stick type cosmetic material will be received inside the claws. When the claws are located at the first slide grooves, the claws retain the stick type cosmetic material by tightly sandwiching the stick type cosmetic material with pressure from the outer circumference side.

DESCRIPTION OF THE PREFERRED EMBODIMENTS

Embodiments of the present invention will be described in detail with reference to the accompanying drawings.

Figure 1:
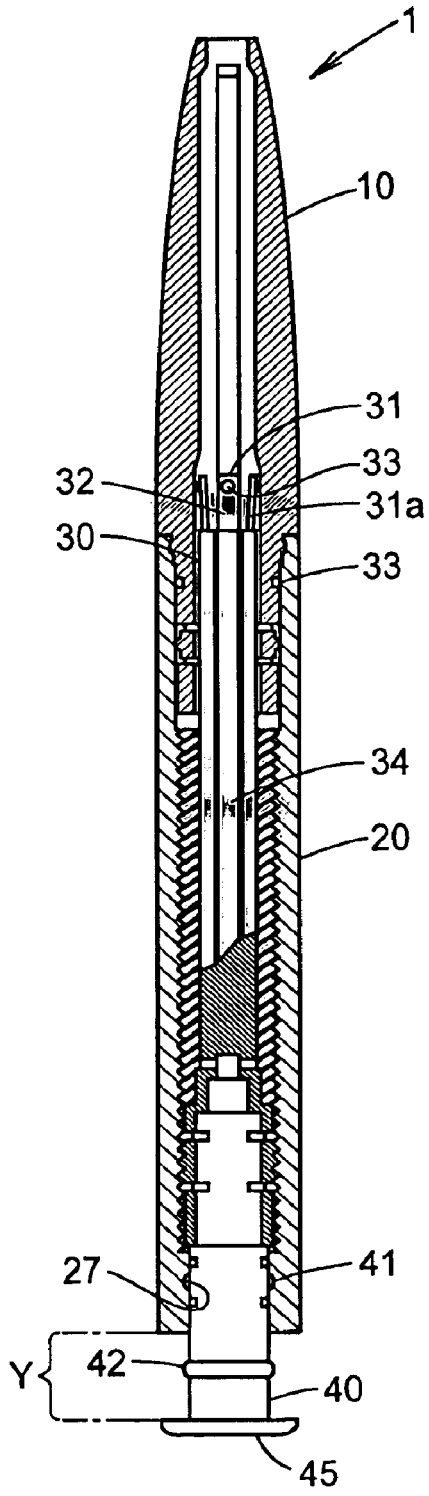
FIG. 1 is a partially longitudinal section showing a stick type cosmetic material feeding container according to a first embodiment.

In FIG. 1, a stick type cosmetic material feeding container 1 has a front cylinder 10 and a base body 20, and a base end of the front cylinder 10 is coaxially fitted in the base body 20, whereby the front cylinder 10 and the base cylinder 20 can mutually rotate. A core chuck member 30 which retains a stick type cosmetic material A and shifts in an axial direction is housed inside the front cylinder 10. A feeding mechanism for shifting the core chuck member 30 by operation of the mutual rotations of the front cylinder 10 and the base body 20 which will be described later is installed in the front cylinder 10 and the base body 20.

A through hole 13 which is continued from a front end opening hole 11 and extends in an axial direction is bored in the shaft center of the front cylinder 10. The through hole 13 is formed so that its inside diameter is slightly smaller than an outside diameter of the stick type cosmetic material A.

Figure 2:
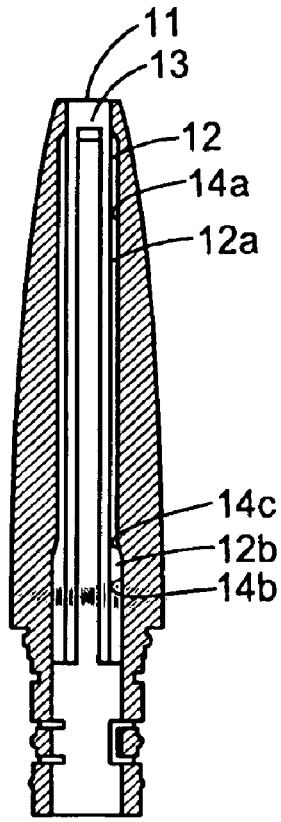
FIG. 2 is a sectional view of a front cylinder to be used in the first embodiment shown in FIG. 1.

Four slide grooves 12 are provided in an axial direction along the through hole 13 in such a manner that the slide grooves 12 surround the through hole 13. As shown in FIG. 2, the slide grooves 12 are provided as first slide grooves 12*a* on the side of the front end opening hole 11 and continued from the ends of the first slide grooves 12*a* through a taper surface 14*c* as second slide grooves 12*b*.

Figure 3:
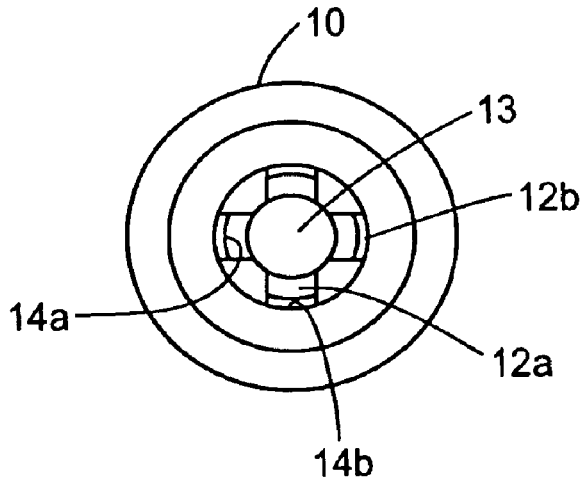
FIG. 3 shows a state of the front cylinder of FIG. 2 viewed from underneath.

FIG. 3 clearly shows shapes of the first slide grooves 12*a* and the second slide grooves 12*b*. The first slide grooves 12*a* and the second slide grooves 12*b* are formed in such a manner that these groove widths are identical, but these groove depths are different. Bottom surfaces 14*b* of the second slide grooves 12*b* are deeper than bottom surfaces 14*a* of the first slide grooves 12*a*. These bottom surfaces 14*a* and 14*b* whose depths differ are connected by the taper surface 14*c* whose depth gradually varies.

A plurality of claws, namely four claws 32 in this embodiment, which slide under the guidance of these slide grooves 12 are provided at a front end section of the core chuck member 30. These claws 32 constitute a stick type cosmetic material retaining section 31. A base end of each of the claws 32 is connected with the core chuck member 30 and a front end of each of the claws 32 is formed as a free end.

These claws 32 retain the stick type cosmetic material A by the mutual inner circumferential surfaces in such a manner that the claws 32 sandwich the stick type cosmetic material A with pressure from its outer circumference. Thus, an inside diameter surface of each of the claws 32 forms a part of a circumference and its inside diameter is slightly smaller than an outside diameter of the stick type cosmetic material A.

A projection 33 is provided as a contact section on a back surface of each of the claws 32. The projections 33 slide and come into contact with the bottom surfaces 14*a* of the first slide grooves 12*a*, but it is arranged such that the projections 33 do not come into contact with the bottom surfaces 14*b* of the second slide grooves 12*b* which are deeper than the first slide grooves 12*a*.

In FIG. 1, the claws 32 formed at a front end of the core chuck member 30 are located at the second slide grooves 12*b*. Because the projections 33 of back surfaces of the claws 32 at this position are not in contact with the bottom surfaces 14*b* of the second slide grooves 12*b*, the claws 32 can elastically be deformed outward in a direction of enlarging the inside diameter of the claws 32. Therefore, at this position, the stick type cosmetic material A inserted through the front end opening hole 11 of the front cylinder 10 reaches a bottom surface 31*a* of the stick type cosmetic material retaining section 31 without meeting with any resistance.

Figure 4:
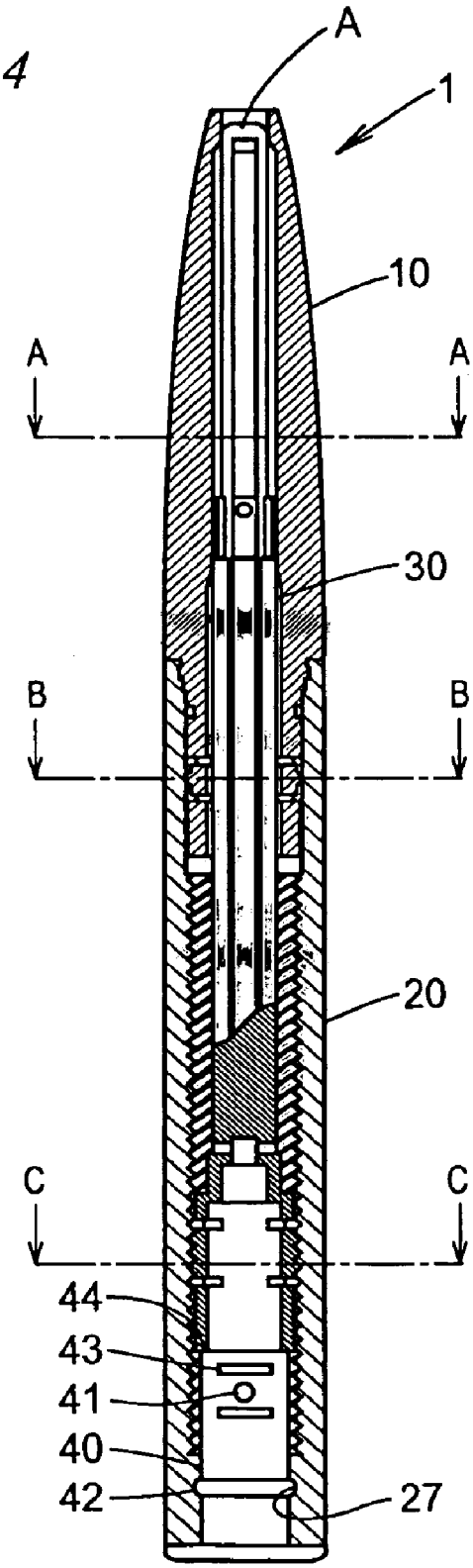
FIG. 4 is a partially longitudinal section showing a state in which a core chuck member already moved in an axial direction retains a stick type cosmetic material.
Figure 5:
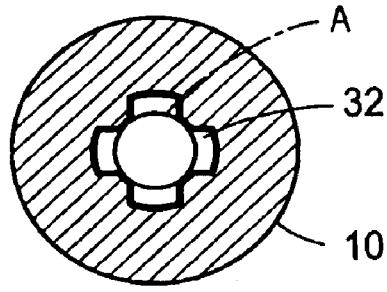
FIG. 5(A) is a sectional view taken along line A—A shown in FIG. 4.
FIG. 5(B) is a sectional view taken along line B—B shown in FIG. 4.
FIG. 5(C) is a sectional view taken along line C—C shown in FIG. 4, respectively.
Figure 5:
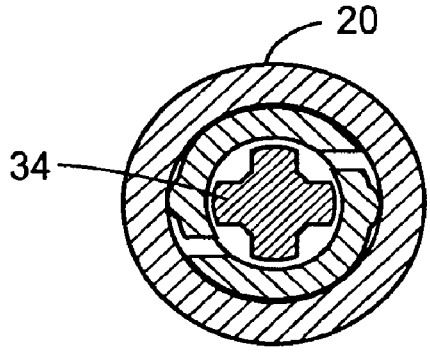
Figure 5:
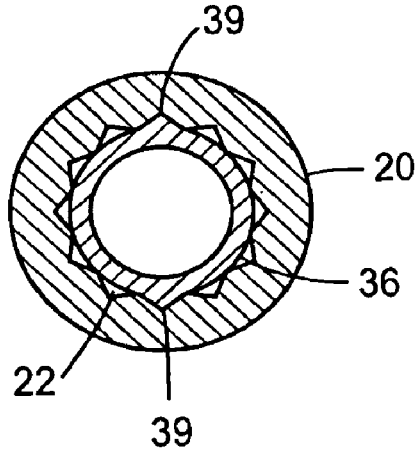
Figure 6:
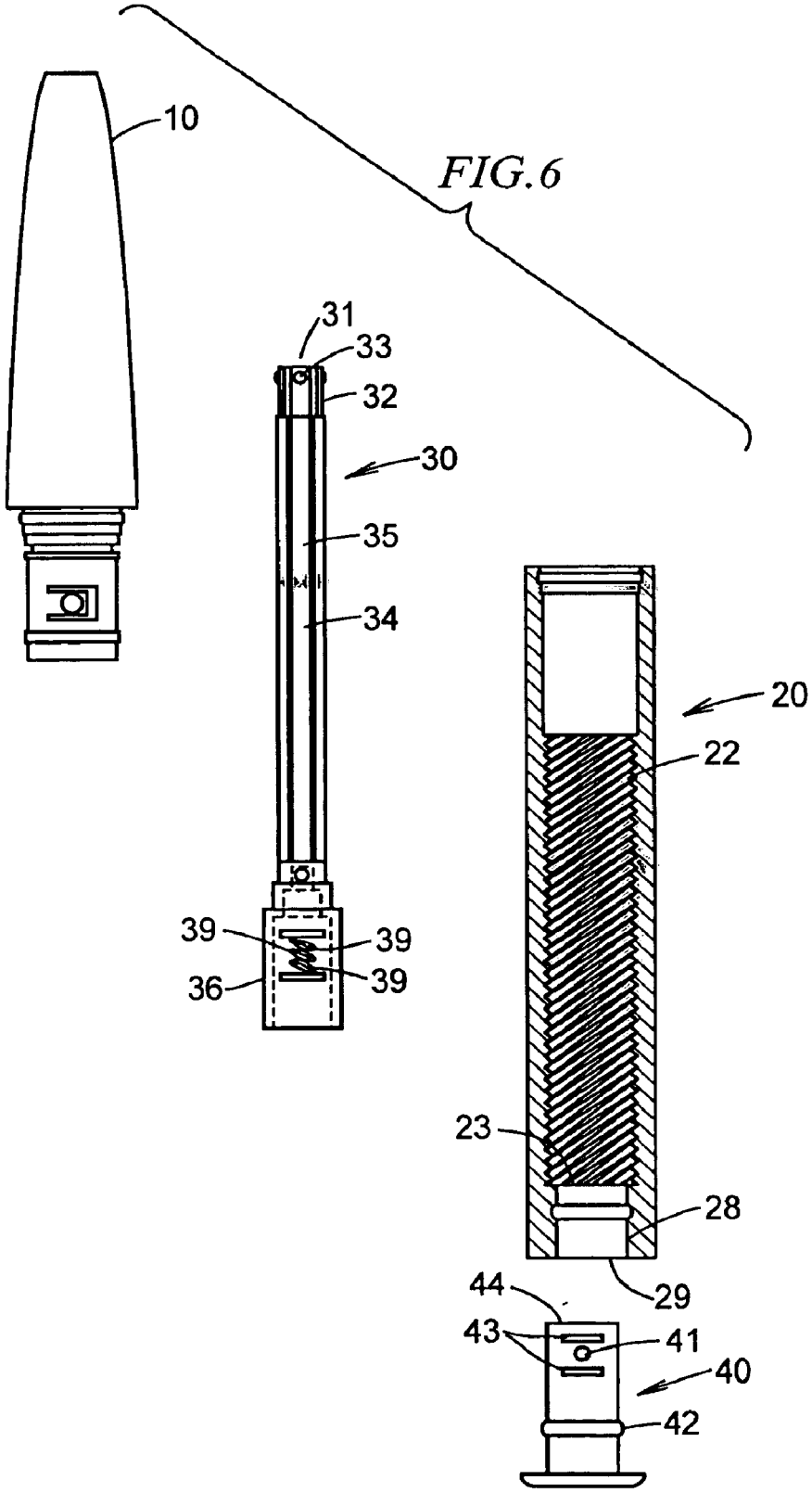
FIG. 6 is a partially longitudinal section showing each member of the stick type cosmetic material feeding container of FIG. 1.

As shown in FIG. 4, the core chuck member 30 shifts in an axial direction toward the side of the front end opening hole 11 of the front cylinder 10 from this state. When the claws 32 enter into the first slide grooves 12*a*, the projections 33 provided on the back surfaces of the claws 32 come into contact with the bottom surfaces 14*a* of the first slide grooves 12*a* and the claws 32 sandwich the stick type cosmetic material A with pressure from four directions to the inside. Thus, the stick type cosmetic material A is securely retained.

Even in this case, however, the claws 32 come into contact with the bottom surfaces 14*a* of the first slide grooves 12*a* through the projections with a small area. Therefore, resistance is not large when the core chuck member 30 shifts along the slide grooves 12, so that the core chuck member 30 can smoothly slide.

Therefore, in the present invention, the core chuck member 30 is mostly retracted in advance and the stick type cosmetic material A is inserted through the front end opening hole 11 until the stick type cosmetic material A comes into contact with the core chuck member 30. The core chuck member 30 is then slightly moved in the axial direction toward the side of the front end opening hole 11 and therefore the stick type cosmetic material A can securely be retained. Further, because the stick type cosmetic material A is retained in such a manner that the stick type cosmetic material A is not deformed and scraped, but wrapped, it is possible to retain the stick type cosmetic material A strongly and securely.

Next, a feeding mechanism of the core chuck member 30 of the stick type cosmetic material feeding container 1 shown in FIG. 1 will be described.

The core chuck member 30 has the claws 32 to be guided by the slide grooves 12 and also linear projections 35 which extend continuously from the claws 32 down the stick type cosmetic material retaining section 31 are formed. The linear projections 35 are slidably engaged with the slide grooves 12 and therefore the core chuck member 30 and the front cylinder 10 are united, thereby constituting a rotation regulating mechanism.

The linear projections 35 are formed at an outer circumference of a shaft 34 of the core chuck member 30, and a cylindrical body 36 which has a diameter larger than that of the shaft 34 is installed at a rear part of the core chuck member 30.

The base body 20 is connected with the front cylinder 10 and also an inner hole extending in an axial direction is formed inside the base body 20. A roulette-shaped spiral 22 is formed at the inner hole.

A plurality of engagement projections 39 are arranged at the cylindrical body 36 which is formed at a rear part of the core chuck member 30, and the engagement projections 39 are elastically and spirally engaged with the roulette-shaped spiral 22 in the base body 20, thereby constituting a spiral engagement mechanism.

More specifically, when the front cylinder 10 is rotated relatively to the base body 20, the core chuck member 30 rotates in one united body with the front cylinder 10 due to the rotation regulating mechanism. Because the engagement projections 39 are spirally engaged with the roulette-shaped spiral 22 of the base body 20, the core chuck member 30 shifts in an axial direction.

Further, it is arranged such that an outside diameter of the cylindrical body 36 is in contact with an inside diameter of the roulette-shaped spiral 22 of the base body 20. When the core chuck member 30 is retracted most, a rear end surface of the core chuck member 30 comes into contact with a stepped section 23 which is provided at a rear part of the base body 20, thereby defining the retreat limit.

In this state, the claws 32 of the stick type cosmetic material retaining section 31 are located at the second slide grooves 12*b* and the stick type cosmetic material A can be loaded as described above.

Further, a tail plug 40 is inserted through an opening hole 29 of the base body 20 into a small diameter section 28 which is formed in the rear of the stepped section 23. The retreat limit of the core chuck member 30 is defined by bringing a front end section 44 of the tail plug 40 into contact with a rear end surface of the cylindrical body 36 of the core chuck member 30, so that the tail plug 40 acts as a regulating means for defining a retreat position of the core chuck member 30.

In this state, the claws 32 of the core chuck member 30 are located at the first slide grooves 12*a* and cannot enter into the second slide grooves 12*b*. Thus, by installing the tail plug 40 at the base body 20 after the stick type cosmetic material A is installed at the core chuck member 30 as described above, the claws 32 can shift in an axial direction by a scope of the first slide grooves 12*a*. Therefore, the claws 32 cannot be deformed in such a manner that an inside diameter of the claws 32 expands toward the outer circumference, and the stick type cosmetic material A can securely be retained by the claws 32.

A pair of slits 43 are provided at the tail plug 40 and a first projection 41 is provided between these slits 43. The first projection 41 fits in a tail plug fit-in groove 27 which is provided at the base body 20 and therefore the tail plug 40 is securely engaged with the base body 20 so that the tail plug 40 will not fall out.

Initially, the tail plug 40 is not installed in the stick type cosmetic material feeding container 1, and the core chuck member 30 is shifted to the retreat limit. In this state, as described above, when the stick type cosmetic material A is loaded, the stick type cosmetic material A reaches the bottom surface 31*a* of the stick type cosmetic material retaining section 31 without meeting with any resistance.

In this state, when a bottom surface of a flange 45 of the tail plug 40 is pressed until a second projection 42 fits in the tail plug fit-in groove 27, the core chuck member 30 pressed by the tail plug 40 shifts in an axial direction by length Y when the tail plug 40 is pressed. Thus, the claws 32 of the core chuck member 30 slide on the taper surface 14*c* from the second slide grooves 12*b* and shift to the first slide grooves 12*a*. Thus, the stick type cosmetic material A is securely retained by the four pieces of claws 32 without being scraped or deformed. This position is the feeding retreat limit of the stick type cosmetic material feeding container 1 in a normal working condition.

The flange 45 of the tail plug 40 is adjusted to the color of the stick type cosmetic material A to be loaded and also a discriminating criterion is manifest such that when the tail plug 40 is exposed from the front cylinder 10 as shown in FIG. 1, the stick type cosmetic material A has not been loaded and when the tail plug 40 is completely pushed in as shown in FIG. 4, the stick type cosmetic material A has been loaded and the stick type cosmetic material feeding container 1 is a finished body. Thus, the stick type cosmetic material feeding container 1 is characterized in that it is easy to handle.

When the front cylinder 10 and the base body 20 are relatively rotated in such a state, a feeding mechanism operates due to both the rotation regulating mechanism, which is constituted by the slide grooves 12 in the front cylinder 10 and the linear projections 35 of the core chuck member 30, and the spiral engagement mechanism, which is constituted by the engagement projections 39 provided at an outer circumference of the cylindrical body 36 of the core chuck member 30 and the roulette-shaped spiral 22 provided in the base body 20. When the core chuck member 30 shifts in an axial direction in the front cylinder 10 in one body with the front cylinder 10, a front end of the stick type cosmetic material A retained by the claws 32 is fed out of the opening hole 11. It is possible to put on makeup in this state.

Figure 7:
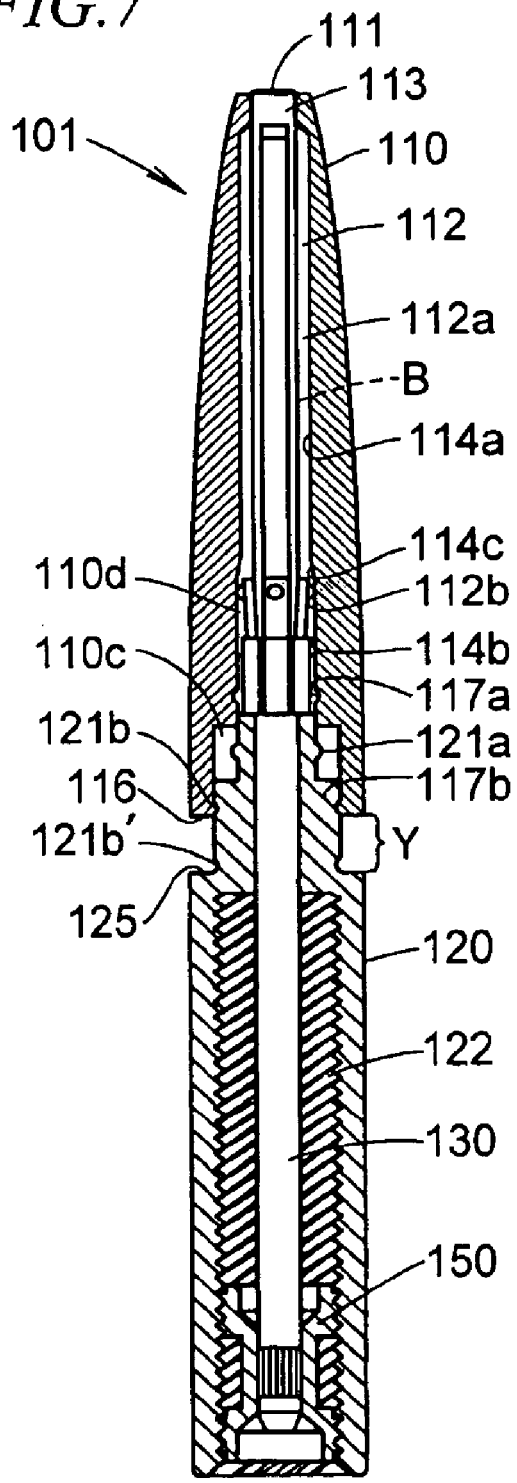
FIG. 7 is a partially longitudinal section showing a stick type cosmetic material feeding container according to a second embodiment.
Figure 8:
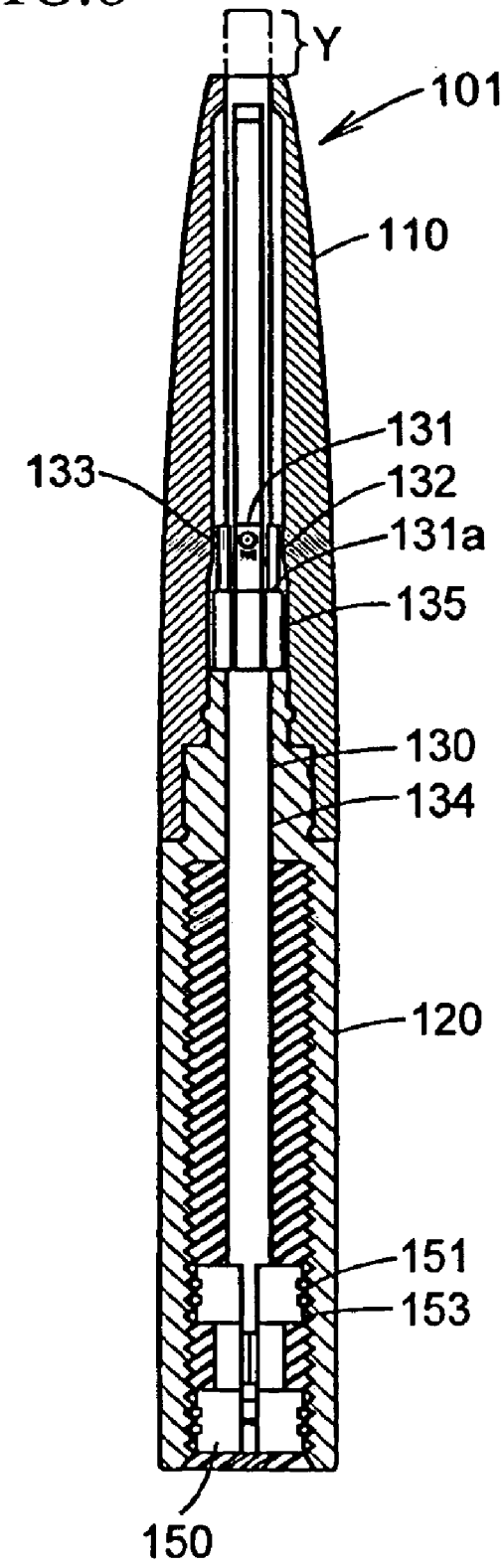
FIG. 8 is a partially longitudinal section showing a finished body of the stick type cosmetic material feeding container shown in FIG. 7.

FIGS. 7 and 8 show a second embodiment of the present invention.

A stick type cosmetic material feeding container 101 comprises four members, such as a front cylinder 110, a base body 120, a core chuck member 130, and a spiral engagement member 150 which is connected with the core chuck member 130 and constitutes a part of a spiral engagement mechanism.

The front cylinder 110 has an opening hole 111 at its front end, and a through hole 113 which is bored and has a diameter almost the same as that of the opening hole 111 is provided. Similarly to the first embodiment, four slide grooves 112 are arranged along the through hole 113.

These slide grooves 112 comprise first slide grooves 112*a* provided at the front part and second slide grooves 112*b* which are provided at the rear part and whose groove depth is deeper than that of the first slide grooves 112*a*. A bottom surface 114*a* of each of the first slide grooves 112*a* is connected with a bottom surface 114*b* of each of the second slide grooves 112*b* via a taper surface 114*c*.

As shown in FIG. 7, when a stick type cosmetic material B is inserted through the opening hole 111 of the front cylinder 110, claws 132 of the core chuck member 130 are caused to locate at the second slide grooves 112*b* and an end surface of the stick type cosmetic material B is caused to come into contact with a bottom surface 131*a* of a stick type cosmetic material retaining section 131 of the core chuck member 130. However, because the claws 132 are expanded, the stick type cosmetic material B is not retained tightly with pressure.

This is because the bottom surfaces 114*b* of the second slide grooves 112*b* are deep and projections 133 of the claws 132 are not in contact with the bottom surfaces 114*b*.

A first cavity section 110*c* having a large diameter and a second cavity section 110*d* whose diameter is smaller than that of the first cavity section 110*c* are formed at the rear parts of the front cylinder 110 coaxially with the through hole 113. A fit-in convex section 117*b* is provided on an inner surface of the first cavity section 110*c* and rotatably engaged with a front part annular concave section 121*b* which is formed at an outer circumference of a front part of the base body 120.

The fit-in convex sections 117*b* are formed at three positions of an inner circumferential end surface of the first cavity section 110*c* of the front cylinder 110.

As described above, in a state in which the front end annular concave section 121*b* is engaged with the fit-in convex section 117*b*, a space equivalent to the length Y is left between a rear end section 116 of the front cylinder 110 and an end surface 125 of the base body 120.

When the front cylinder 110 is pressed toward the base body 120 after the stick type cosmetic material B is inserted through the front end opening hole 111 of the front cylinder 110 up to the bottom surface 131*a* of the stick type cosmetic material retaining section 131 of the core chuck member 130, the four claws 132 which constitute the stick type cosmetic material retaining section 131 located at the retreat limit shift to the first slide grooves 112*a* from the second slide grooves 112*b* via the taper surfaces 114*c*, and the projections 133 on back surfaces of the claws 132 come into contact with the bottom surfaces 114*a* of the first slide grooves 112*a*. Thus, the claws 132 are pressed toward the inside diameter and it is possible to retain the stick type cosmetic material B by the claws 132 with fixed retaining force.

This position is a substantial feeding retreat limit of a stick type cosmetic material.

According to the first embodiment, the retreat limit is defined by shifting the core chuck member 30, but according to the second embodiment, the position of the core chuck member 130 is not changed and the front cylinder 110 is in a condition to be shifted.

Thus, according to the second embodiment, it is determined such that feeding retreat limits of an empty container of FIG. 7 and the stick type cosmetic material feeding container 101 of FIG. 8 in which the stick type cosmetic material B is loaded are at the same position.

Further, when the front cylinder 110 is pressed toward the base body 120, the fit-in convex section 117*b* which has fitted in the front part annular concave section 121*b* of the base body 120 comes off. The fit-in convex section 117*b* then fits in a rear part annular concave section 121*b'* and also a fit-in concave section 117*a* provided at the second cavity section 110*d* of the front cylinder 110 is engaged with a fit-in convex section 121*a* of the base body 120. Thus, the front cylinder 110 and the base body 120 are securely connected.

In a state of FIG. 7 in which a space equivalent to the length Y is left between the front cylinder 110 and the base body 120 and then the stick type cosmetic material B is fully loaded in the front end opening hole 111, the front cylinder 110 is pushed so as to eliminate a space equivalent to the length Y. Thus, the claws 132 are pushed up to the first slide grooves 112*a* and the stick type cosmetic material B is retained as shown in FIG. 8.

Thus, the stick type cosmetic material B protrudes from the front end opening hole 111 of the front cylinder 110 by the length of Y, so that it is possible to cut the stick type cosmetic material B in normal length.

The stick type cosmetic material feeding container 101 becomes a finished body by shifting to a state shown in FIG. 8. Due to rotary operation of the front cylinder 110 and the base body 120, an engagement projection 151 provided at an outer circumferential wall 153 of the spiral engagement member 150 which is connected with a shaft 134 of the core chuck member 130 is spirally engaged with a roulette-shaped spiral 122 formed at an inside diameter of the base body 120, thereby constituting a spiral engagement mechanism. Also, when convex sections 135 provided at lower parts of the claws 132 are engaged with the slide grooves 112 in the front cylinder 110, a rotation regulating mechanism operates. Thus, the stick type cosmetic material B retained by the claws 132 of the core chuck member 130 advances and retreats through the opening hole 111 of the front cylinder 110 and it is possible to put on makeup.

The stick type cosmetic material feeding container 101 according to the second embodiment protects the feeding mechanism and the stick type cosmetic material B against a rotary load at the advance limit and the retreat limit due to a clutch rotation of the shaft 134 of the core chuck member 130 with respect to the spiral engagement member 150.

Figure 9:
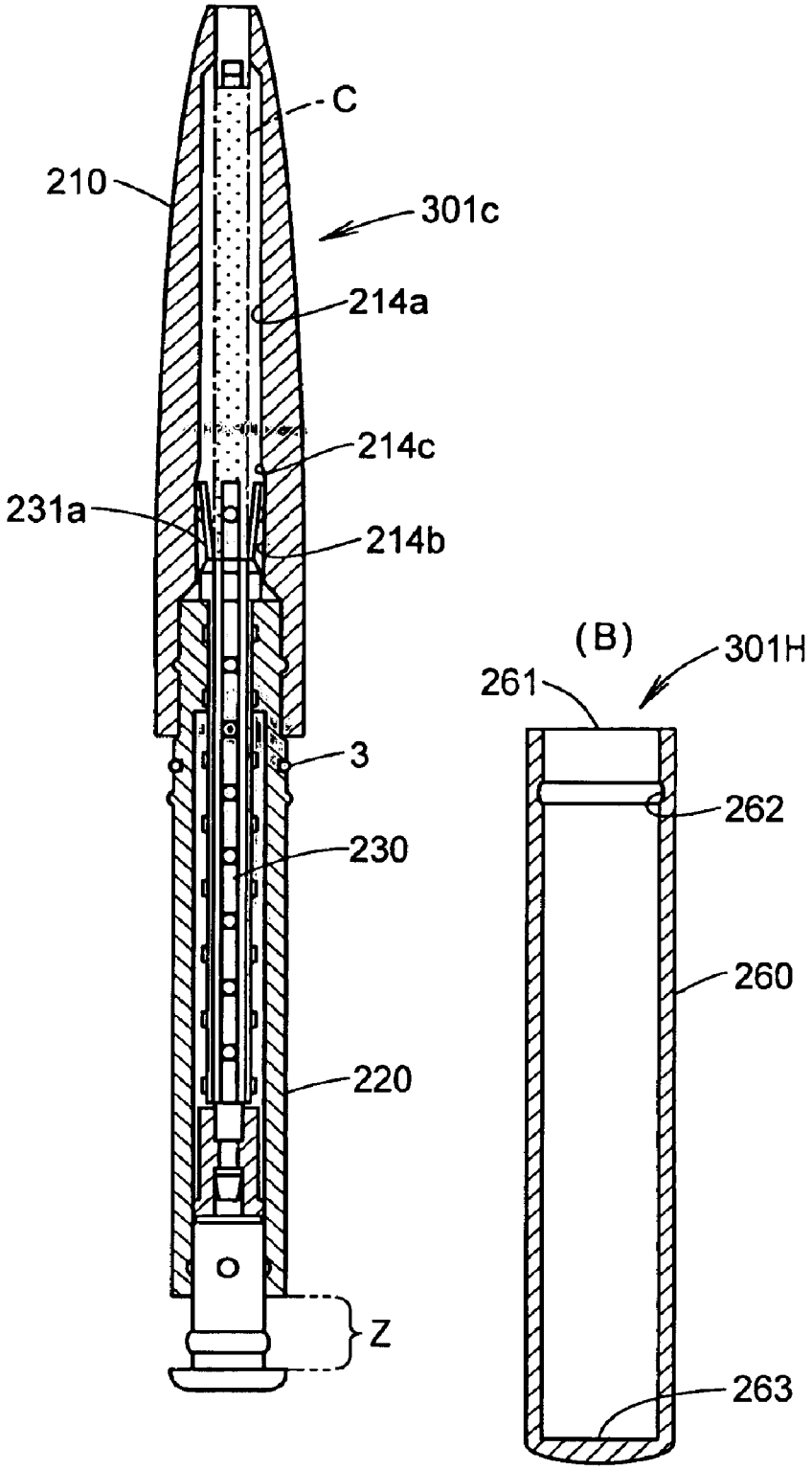
FIG. 9 is a partially longitudinal section showing a cartridge type stick-shaped cosmetic material feeding container according to a third embodiment.
Figure 10:
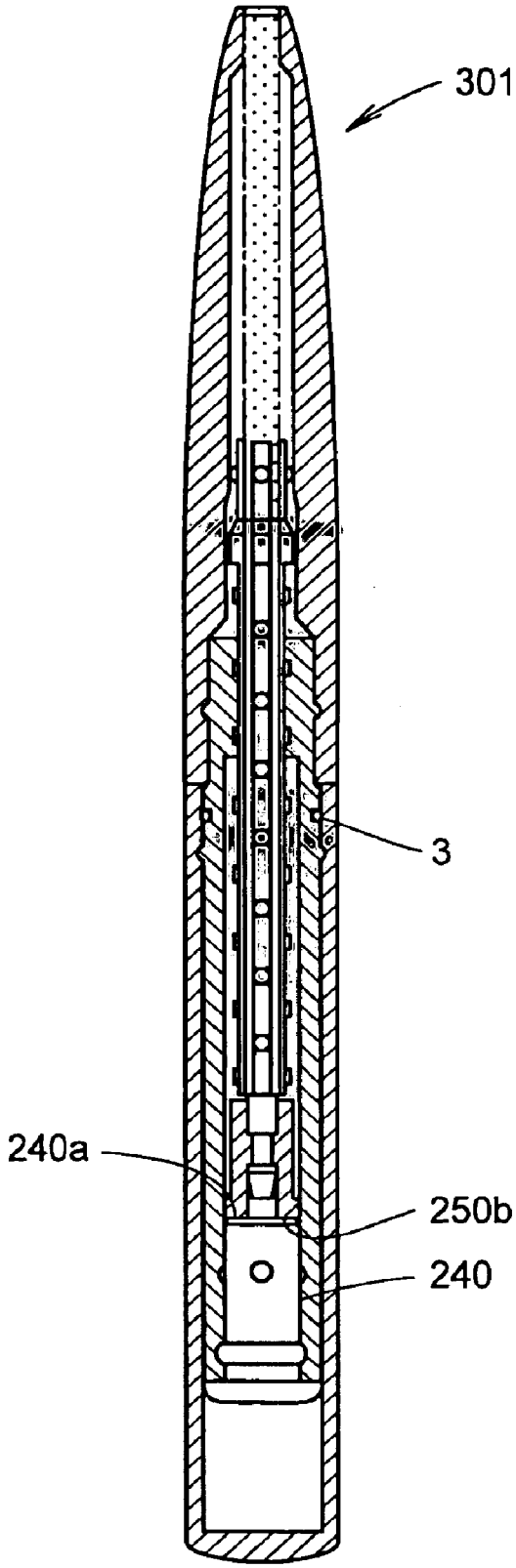
FIG. 10 is a partially longitudinal section showing a state in which the cartridge type stick-shaped cosmetic material feeding container according to the third embodiment has been fabricated.
Figure 11:
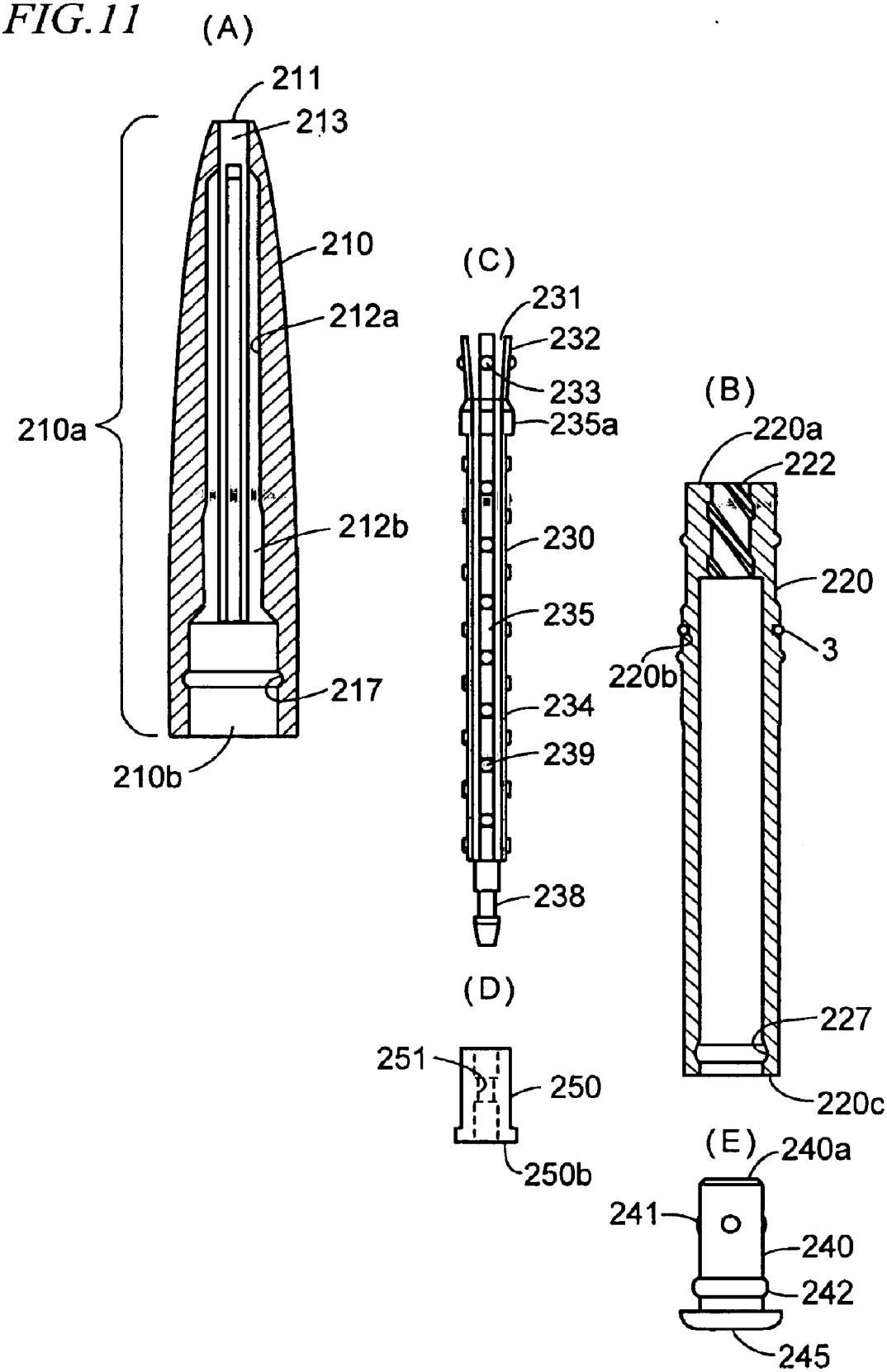
FIG. 11 is an exploded view of the cartridge type stick-shaped cosmetic material feeding container shown in FIG. 10.
Figure 12:
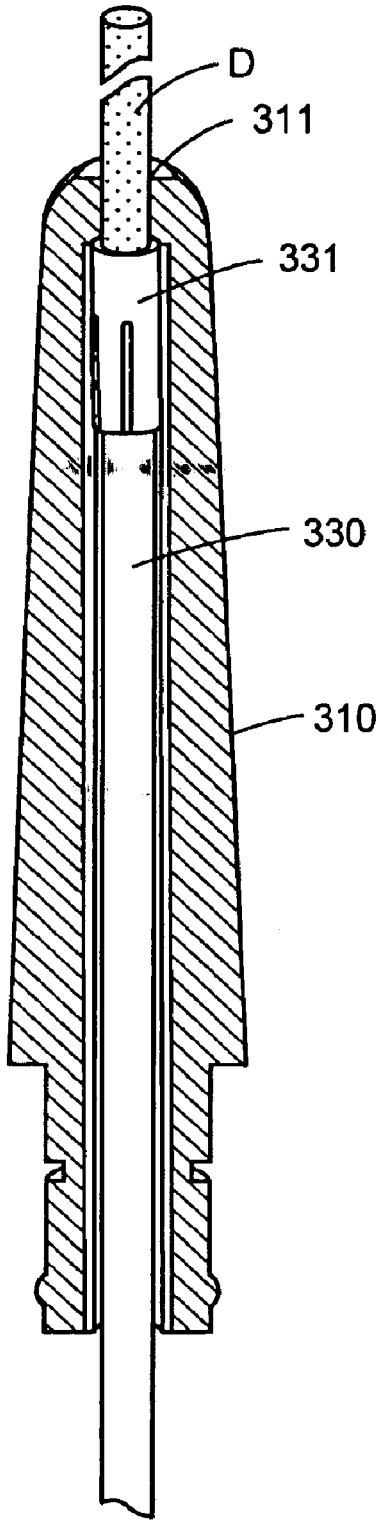
FIG.12 PRIOR ART
FIG. 12 is an explanatory drawing of a conventional example.
Figure 13:
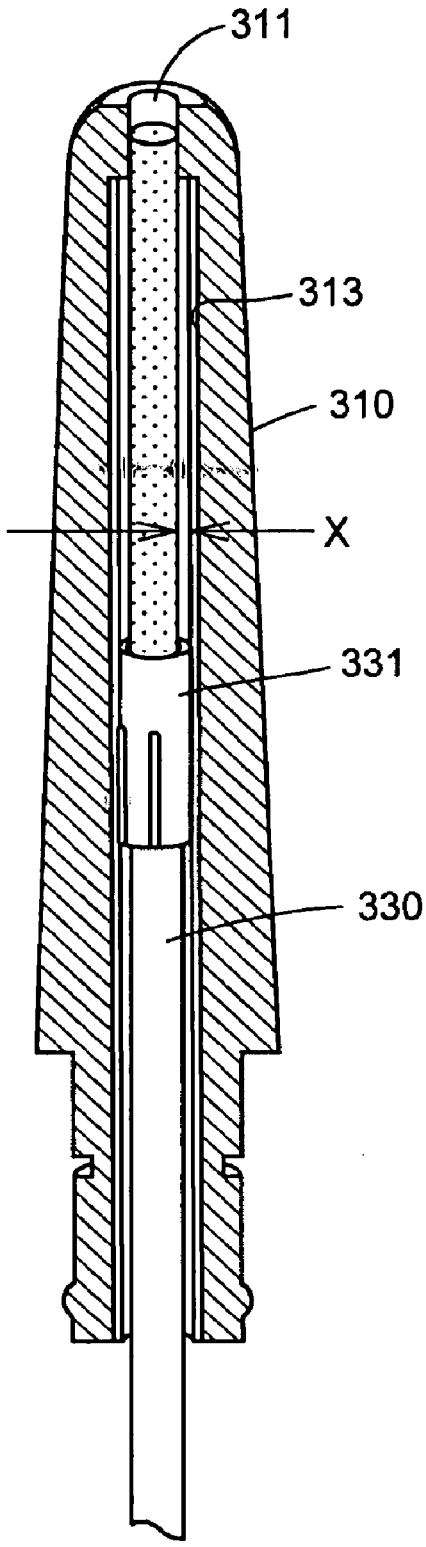
FIG. 13 PRIOR ART
FIG. 13 is an explanatory drawing of the conventional example, similarly.

FIGS. 9, 10, and 11 show a third embodiment of the present invention.

The third embodiment represents a cartridge type stick-shaped cosmetic material feeding container 301. FIG. 9(A) is a partially longitudinal section showing a cartridge 301C, and FIG. 9(B) shows a holder 301H to house the cartridge 301. FIG. 10 shows that the cartridge 301C, in which a stick type cosmetic material C is loaded, is housed in the holder 301H, in other words, FIG. 10 shows the cartridge type stick-shaped cosmetic material feeding container 301.

FIG. 11 shows each member of the cartridge 301C. FIG. 11(A) shows a front cylinder 210, FIG. 11(B) shows a base body 220, and FIG. 11(C) shows a core chuck member 230. FIG. 11(D) shows a stopper member 250 which fits in a concave section 238 provided at a rear part of the core chuck member 230 and defines a feeding stroke end of the core chuck member 230. FIG. 11(E) shows a tail plug 240 which fits in a tail plug fit-in section 227 of the base body 220, and the tail plug 240 is formed by an elastic body, such as an elastomer.

The cartridge 301C shown in FIG. 9(A) will be described in detail with reference to each member which constitutes the cartridge 301C of FIG. 11.

A pinch section 210*a* to be used for rotations is provided at an outer circumference section of the front cylinder 210 and a base body fit-in cavity section 210*b* is provided at an inside diameter rear part of the front cylinder 210. Further, the front cylinder 210 is rotatably connected with the base body 220 due to a fit-in concave section 217 provided at an inner circumference of a cavity section 201*b*.

The base body 220 is formed in the shape of a cylinder and a spiral 222 is formed at an inside diameter of a front part. Also, an O-ring 3 is wound to an O-ring groove 220*b* provided at the outer circumference and the tail plug fit-in section 227 is provided at an inside diameter of the rear part.

With respect to the tail plug 240, a first projection 241 fits in the tail plug fit-in section 227. This shows a state of the cartridge 301C of FIG. 9(A).

In the third embodiment, a method for loading the stick type cosmetic material C in the cartridge 301C is shown. FIG. 9(A) shows a state where the stick type cosmetic material C is in contact with a bottom surface 231*a* of a stick type cosmetic material retaining section 231 constituted by claws 232 already formed at a front end of the core chuck member 230. The state shows that the stick type cosmetic material C has not been retained by the claws 232 in such a manner that the claws 232 tightly sandwich the stick type cosmetic material C with pressure.

In FIG. 11, a through hole 213 having almost the same diameter as that of an opening hole 211 at a front end is bored in the front cylinder 210. Four first slide grooves 212*a* are formed in an axial direction along the through hole 213 and connected with second slide grooves 212*b* through taper surfaces 214*c*.

Four claws 232 are formed at a front end of the core chuck member 230, and linear projection front end sections 235*a* are provided at base sections of the claws 232. A lower end section of the core chuck member 230 is placed on a front end section 220*a* of the base body 220 and also back surfaces of the linear projection front end sections 235*a* are engaged with the second slide grooves 212*b,* thereby constituting a rotation regulating mechanism.

In FIG. 9(A), when the claws 232 are located at the second slide grooves 212*b,* projections 233 provided at back surfaces of the claws 232 are not supposed to come into contact with bottom surfaces 214*b* of the second slide grooves. The stick type cosmetic material C inserted through the opening hole 211 of the front cylinder 210 reaches the bottom surface 231*a* of the stick type cosmetic material feeding section 231 without meeting with any resistance of the claws 232.

A shaft 234 is formed at the core chuck member 230 and a linear projection 235 is arranged at an outer circumferential surface of the core chuck member 230. A large number of engagement projections 239 are formed in line on a surface of the linear projection 235 and these engagement projections are male screws and are spirally engaged with the spiral 222 provided at a front part of the base body 220, thereby constituting a spiral engagement mechanism.

Further, as shown in FIG. 11, a convex section 251 of the stopper member 250 fits in the concave section 238 provided at a rear part of the shaft 234, and the front cylinder 210, the base body 220, the core chuck member 230, the stopper member 250, and the tail plug 240 constitute the cartridge 301C.

In the state shown in FIG. 9(A), a space equivalent to length Z is left between a flange 245 of the tail plug 240 and a rear end section 220C of the base body 220, and a front end section 240*a* of the tail plug 240 comes into contact with a rear end section 250*b* of the stopper member 250. When the tail plug 240 is pushed in the base body 220, the first projection 241 of the tail plug 240 which is engaged with the tail plug fit-in section 227 of the base body 220 comes off. The base body 220 is blocked with the flange 245 of the tail plug 220 and also a second projection 242 fits in the tail plug fit-in section 227.

The stopper member 250 which is pushed by the front end section 240*a* of the tail plug 240 causes the core chuck member 230 to shift in an axial direction.

Because the claws 232 located at the second slide grooves 212*b* shift to the first slide grooves 212*a* via the taper surfaces 214*c,* the projections 233 on back surfaces of the claws 232 come into contact with the bottom surfaces 214*a* of the first slide grooves 212*a.* Thus, the claws 232 are prevented from spreading out and the stick type cosmetic material C is retained in such a manner that the claws 232 tightly sandwich the stick type cosmetic material C with pressure.

The method for retaining the stick type cosmetic material C by shifting the tail plug 240 conforms to the retaining method in the stick type cosmetic material feeding container 1 as shown in FIG. 1.

The holder 301H shown in FIG. 9(B) is constituted by an external cylinder 260 having a bottom surface 263 and has at its front end an opening hole 261 capable of housing the cartridge 301C. The holder 301H also has on its inner circumferential surface an annular fit-in concave section 262 which moors the cartridge 301C.

Operation of the cartridge type stick-shaped cosmetic material feeding container 301 will be described with reference to FIG. 10.

As described above, the cartridge 301C in which the stick type cosmetic material C is retained and housed is housed in the holder 301H. Due to frictional resistance of the inner circumferential surface of the holder 301H and the base body 220 arising resulting from the O-ring 3 wound to the base body 220, the base body 220 is united in one body with the holder 301H and the base body 220 rotates synchronously with the holder 301H. Therefore, rotary operation of the cartridge 301C and the holder 301H corresponds to rotations of the front cylinder 210 and the base body 220.

With respect to the core chuck member 230, the rotation regulating mechanism operates by engagement of the second slide grooves 212*b* of the front cylinder 210 and the linear projection 235, and also the feeding mechanism operates due to the spiral engagement mechanism constituted by the spiral 222 of the base body 220 and the large number of engagement projections 239 which are arranged on a surface of the linear projection 235. Thus, the stick type cosmetic material C retained by the claws 232 advances and retreats through the opening hole 211 provided at a front end of the front cylinder 210 and it is possible to put on makeup.

The stick type cosmetic material to be used in each of the above embodiments is not restricted to such a configuration that the cross section is a circular core. Even though the cross section is an elliptical core or a square core, it is possible to sufficiently retain the stick type cosmetic material depending on the shape or the number of claws. Further, it is possible to apply not only to the stick type cosmetic material having a thin diameter, such as an eyeliner and an eyebrow pencil, but also to the stick type cosmetic material having a large diameter, such as a lipstick and foundation.

The present invention is not restricted to the embodiments described above. It includes various modifications or improvement which can be made by a person skilled in the art within the scope of the description as set forth in the claims of the present invention.

What is claimed is:

1. A stick type cosmetic material feeding container, comprising:

a core chuck member adapted to retain a stick type cosmetic material;

a front cylinder; and a base body rotatably connected with the front cylinder;

wherein due to relative rotations of the front cylinder and the base body, the stick type cosmetic material retained by the core chuck member slides forward and backward along a through hole extending in an axial direction in the front cylinder;

wherein a plurality of first slide grooves are formed along an inner circumference of the front cylinder and along the through hole, the through hole having an inside diameter which is almost equal to an outside diameter of the stick type cosmetic material, the first slide grooves extending in the axial direction;

wherein a plurality of second slide grooves are located at ends of the first slide grooves, formed continuously from the ends, formed deeper than the first slide grooves, and are disposed to correspond to a position of the core chuck member when the core chuck member is in a maximum retracted position;

wherein a plurality of claws are formed at a front end section of the core chuck member so as to retain the stick type cosmetic material and are slidably guided by the first slide grooves and the second slide grooves, back surfaces of the claws slide and come into contact with bottoms of the first slide grooves, and inner surfaces of the claws almost coincide with the inside diameter of the through hole when the claws are disposed in the first slide grooves, and wherein when the claws are disposed in the second slides grooves, the claws will elastically deform outward toward an outer circumference of the front cylinder so that the inner surfaces of the claws will be disposed to form an opening that is larger than the inside diameter of the through hole, so that when the stick type cosmetic material is loaded in the core chuck member and the claws are located at the second slide grooves, the stick type cosmetic material may be received in the opening and inside the claws, and when the claws are located at the first slide grooves, the opening is made smaller and the claws retain the stick type cosmetic material by tightly sandwiching the stick type cosmetic material with pressure on an outer circumference side of the stick type cosmetic material.

2. A stick type cosmetic material feeding container according to claim 1, wherein bottoms of the first slide grooves are connected with bottoms of the second slide grooves which are deeper than the bottoms of the first slide grooves via taper surfaces.

3. A stick type cosmetic material feeding container according to claim 1, wherein projections which slide and come into contact with the bottoms of the first slide grooves are provided on the back surfaces of the claws.

4. A stick type cosmetic material feeding container according to claim 1, further comprising regulating means for defining a retreat position of the core chuck member so that the claws do not retreat to the second slide grooves after the stick type cosmetic material is loaded in the core chuck member.

* * * * *